US007643779B2

(12) United States Patent
Mabuchi et al.

(10) Patent No.: US 7,643,779 B2
(45) Date of Patent: Jan. 5, 2010

(54) DEVELOPER TRANSPORTING AMOUNT CONTROLLING MEMBER, DEVELOPING APPARATUS, IMAGING APPARATUS, AND METHOD FOR EXCHANGING DEVELOPING UNIT

(75) Inventors: Hiroyuki Mabuchi, Ibaraki (JP); Takao Umeda, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 493 days.

(21) Appl. No.: 11/604,508

(22) Filed: Nov. 27, 2006

(65) Prior Publication Data

US 2007/0196138 A1 Aug. 23, 2007

(30) Foreign Application Priority Data

Feb. 20, 2006 (JP) ..... 2006-042603

(51) Int. Cl.
*G03G 15/09* (2006.01)
*G03G 15/00* (2006.01)

(52) U.S. Cl. ..... 399/274; 399/109

(58) Field of Classification Search ..... 399/273, 399/274, 283, 284, 109, 119
See application file for complete search history.

(56) References Cited

U.S. PATENT DOCUMENTS 4,585,328 A * 4/1986 Moser et al. ..... 399/274
5,084,739 A * 1/1992 Kalyandurg et al. ..... 399/273
5,128,716 A * 7/1992 Kita ..... 399/274
5,545,840 A * 8/1996 Doi et al. ..... 399/274
7,058,349 B2 * 6/2006 Kamimura ..... 399/274
2002/0018672 A1 * 2/2002 Ozawa et al.
2006/0067741 A1 * 3/2006 Azami
2006/0127792 A1 * 6/2006 Matsuzaki
2009/0047046 A1 * 2/2009 Azami

FOREIGN PATENT DOCUMENTS

JP 57-136671 8/1982
JP 2005-91953 4/2005

* cited by examiner

*Primary Examiner*—Susan S Lee
(74) *Attorney, Agent, or Firm*—Ladas & Parry LLP

(57) ABSTRACT

A developer transporting amount controlling member that is used in a developing apparatus is disclosed. The developing apparatus includes a recording unit having a surface that sustains an electrostatic latent image and attracts a developer, a developer transporting unit that transports the developer, and a developing unit that guides the developer to the recording unit. The recording unit, the developer transporting unit, and the developing unit have rotational center axes that are parallel to each other. The developer transporting amount controlling member includes a magnetic part and a nonmagnetic part that is harder than the magnetic part and is fixed to the developing apparatus such that a portion of the nonmagnetic part is disposed closest to the developing unit.

11 Claims, 5 Drawing Sheets

DEVELOPER TRANSPORTING AMOUNT CONTROLLING MEMBER, DEVELOPING APPARATUS, IMAGING APPARATUS, AND METHOD FOR EXCHANGING DEVELOPING UNIT

BACKGROUND OF THE INVENTION

1. Field of the Invention

The present invention relates to a developer transporting amount controlling member, a developing apparatus, an imaging apparatus, and a method for exchanging a developing unit.

2. Description of the Related Art

An imaging apparatus such as a printer or a copier may include a developing apparatus and a so-called photoconductor drum as a recording unit. In an imaging apparatus having such a configuration, an image may be recorded by charging the photoconductor drum at a predetermined potential and exposing light on the photoconductor drum according to recording image information so that a latent image may be formed on the photoconductor drum. Then, toner as an image visualizing agent may be supplied from the developing apparatus to transform the electrostatic latent image on the photoconductor drum into a visible image (toner image). Then, the visible image may be transferred and fixed to a recording medium to be printed.

The developing apparatus as is described above may include a developer accommodating container, a developer transporting unit, a developing roller as a developing unit, a developer transporting amount controlling member, and a toner supplying unit, for example.

The developer may be a two-component developer made up of toner and magnetic powder referred to as "carrier" used for charging and transporting the toner. The toner and the carrier may be combined at a predetermined combination ratio, for example. Such a developer is stirred by the developer transporting unit so that the toner and the carrier contained in the developer come into frictional contact with each other. In turn, the toner may be charged to a predetermined potential to be adhered to the carrier.

The toner adhered to the carrier is guided by a developing roller that has plural magnets arranged in its interior and a rotating sleeve roller arranged at its periphery. The toner is attracted to the surface of the developing roller by the magnetic force of the magnets arranged inside the developing roller, and the toner adhered to the surface of the developing roller is transported by the rotation of the sleeve roller to pass through a gap created between the developing roller and a developer transporting amount controlling member referred to as "doctor blade" that is arranged opposite the developing roller and is configured to control the amount of developer transported by the sleeve roller to a predetermined amount.

The developer controlled by the doctor blade is transported to a position opposite the photoconductor drum through rotation of the sleeve roller so that the toner comes into contact with the photoconductor drum. At this point, a bias voltage (referred to as "developing bias" hereinafter) is applied to the developing roller, and an electric field is generated by interaction with the static latent image formed on the photoconductor drum. In turn, the charged toner is adhered to an image forming position on the photoconductor drum by the generated electric field so that the electrostatic latent image may be developed on the photoconductor drum.

It is noted that one of plural magnetic poles is arranged at the position of a developing portion of the developing roller opposite the photoconductor drum where the developer adhered to the developing roller comes into contact with the photoconductor drum to develop an image. In this case, the line of magnetic force of the magnetic pole is directed away from the developing roller. Accordingly, the carrier extends along the direction of the line of magnetic force away from the developing roller and toward the photoconductor drum to form magnetic bead chains that are suspended from the surface of the sleeve roller of the developing roller, such magnetic bead chains forming a so-called magnetic brush.

In recent years and continuing, with the growing demand for higher image quality, techniques are being developed for reducing the particle size of the carrier included in the developer. By reducing the particle size of the carrier, the beads of the developer coming into frictional contact with the surface of the photoconductor drum may become finer, and the electrostatic latent image formed on the photoconductor drum may be developed more accurately so that a fine image with reduced roughness may be generated.

However, when the particle size of the carrier is reduced, the magnetic force for holding the carrier at the developing apparatus may be reduced so that carrier jumping may easily occur. In order to prevent jumping of such small carrier particles, the magnetic force acting on the carrier particles has to be adequate for maintaining the carrier particles adhered to the tip of the magnetic brush.

In this respect, the bead chain length of the magnetic brush is preferably reduced. However, when the bead chain length of the magnetic brush is reduced, a developing gap corresponding to the closest distance between the developing roller and the photoconductor drum, and a doctor gap corresponding to the closest distance between the doctor blade and the developing roller have to be reduced as well.

When the doctor gap is arranged to be narrow, variations may occur in the doctor gap due to deviations in the processing accuracy or assembling accuracy of device components, and it may be difficult to adjust the transporting amount of developer passing through the doctor gap to a fixed amount. Also, when the developer transporting amount is increased, the mechanical scratching force of the magnetic brush at the developing portion may be increased so that scratch marks of the carrier may be formed on the developed image, for example. On the other hand, when the developer transporting amount is less than a desirable amount, the image density may not reach a target value, or unevenness in the image density may occur. Accordingly, measures need to be taken to reduce variations in the transporting amount of the developer on the developing roller with respect to the variations in the doctor gap.

Also, when the doctor gap is arranged to be narrow, stress applied to the developer passing through the doctor gap may be increased so that high image quality printing may not be maintained for a long period. In this respect, stress applied to the developer at the doctor gap is preferably decreased.

It is noted that a technique is disclosed in Japanese Laid-Open Patent Publication No. 2005-91953 for reducing the developer transporting amount while securing a relatively wide doctor gap. According to the disclosed technique, a magnetic member is fixed to a nonmagnetic doctor blade, and the doctor blade is disposed opposite the magnetic pole of the developing roller to control the developer transporting amount.

With such a configuration, the developer transporting amount may be controlled with the magnetic brush extending in the direction of the line of magnetic force so that the amount of developer transported to the developing portion may be controlled to be a relatively small amount even when the doctor gap is relatively wide. Also, the doctor gap width may be flexibly adjusted to be within a wider dimension range for obtaining the same developer transporting amount so that variations in the developer transporting amount may be reduced with respect to variations in the doctor gap and the stress applied to the developer may be reduced.

Japanese Laid-Open Patent Publication No. 2005-91953 also discloses a technique for countering unevenness of the developer transporting amount with respect to the developing roller axis direction due to bending or deformation of the doctor blade as a result of receiving a force from the developer upon controlling the developer transporting amount. According to the disclosed technique, the shape of the magnetic member is adjusted along the developing roller axis direction so that the magnetic field at the center portion of the developing roller may be strengthened.

Also, other configurations of the doctor blade have been developed for controlling the developer transporting amount including a doctor blade having a tip portion made of magnetic material for controlling the layer thickness of developer and other portions made of nonmagnetic material, a doctor blade having a magnetic member attached to a nonmagnetic member, the doctor blade having an interleaved structure in which a resin member made of resin material such as PTFE (polytetrafluoroethylene) is arranged on both sides of a magnetic member (e.g., see Japanese Laid-Open Patent Publication No. 57-136671).

It is noted that there is a growing demand for the development of techniques for achieving high image quality even in an imaging apparatus adapted for high speed image formation (e.g., image printing). In such a high speed imaging apparatus, the peripheral speed of the developing roller has to be increased in order to secure an adequate image (printing) density. For example, the developing roller may have to be operated at a peripheral speed of at least 1.0 m/s.

However, in such a high speed apparatus, the doctor blade and the surface of the developing roller may wear out as a result of friction with the developer upon controlling the developer transporting amount.

When the doctor blade wears out, the doctor gap may widen and the developer transporting amount may change as a result. Also, a hard material that can adequately resist wear has to be used for the portion of the doctor blade that controls the layer thickness of the developer. That is, soft magnetic material that is normally used for the magnetic member of the doctor blade such as soft magnetic iron may not be used since such material does not have adequate resistance to wear.

The surface of the sleeve roller of the developing roller is roughened through sand blasting or thermal spraying in order to stably transport the developer. However, when the roughness of the surface is reduced by wear, the developer may slide across the surface so that stable transportation of the developer may be hampered. Therefore, the developer roller has to be exchanged when its surface is worn out.

When a magnetic material is used for the doctor blade, carrier particles adhere to the doctor blade due to the magnetic force of the magnetic material. Such carrier particles adhered to the doctor blade may be an obstacle to measuring and adjusting the doctor gap after exchanging the developing roller.

SUMMARY OF THE INVENTION

According to one aspect of the present invention, a technique is provided for enabling high quality image printing for a long period of time even in an apparatus that is adapted to perform high speed printing, facilitating readjustment of the doctor gap upon exchanging the developing unit, and thereby improving the capacity operating rate.

According to an embodiment of the present invention, a developer transporting amount controlling member is provided that is used in a developing apparatus including a recording unit having a surface that sustains an electrostatic latent image and attracts a developer, a developer transporting unit that transports the developer, and a developing unit that guides the developer to the recording unit, which recording unit, developer transporting unit, and developing unit have rotational center axes that are parallel to each other, the developer transporting amount controlling member including:

a magnetic part; and a nonmagnetic part that is harder than the magnetic part and is fixed to the developing apparatus such that a portion of the nonmagnetic part is disposed closest to the developing unit.

In one aspect of the present embodiment, high image quality printing may be maintained for a long period of time even in an apparatus that is adapted to perform high speed printing. In another aspect of the present embodiment, readjustment of the doctor gap upon exchanging the developing unit may be easily performed so that the capacity operating rate may be improved.

According to a preferred embodiment of the present invention, the magnetic part and the nonmagnetic part are configured to be attached and detached from each other.

In one aspect of the present embodiment, the magnetic part may be easily detached from the nonmagnetic part upon exchanging the developing unit so that carrier particles of the developer may be prevented from adhering to the developer transporting amount controlling member and the doctor gap may be easily adjusted.

According to another embodiment of the present invention, a developing apparatus is provided that includes:

a recording unit having a surface that sustains an electrostatic latent image and attracts a developer;

a developer transporting unit that transports the developer;

a developing unit that includes a plurality of magnetic poles and is configured to guide the developer to the recording unit; and a developer transporting amount controlling member that is disposed opposite a first magnetic pole of the magnetic poles of the developing unit; wherein the recording unit, the developer transporting unit, and the developing unit have rotational center axes that are parallel to each other;

the developer is transported to the developing unit by the developer transporting unit and is used to develop the latent image formed on the surface of the recording unit into a visible image; and the developer transporting amount controlling member includes a magnetic part and a nonmagnetic part that is harder than the magnetic part, the nonmagnetic part being fixed in position such that a portion of the nonmagnetic part is disposed closest to the developing unit.

In one aspect of the present embodiment, high image quality printing may be maintained for a long period of time even in an apparatus that is adapted to perform high speed printing. In another aspect of the present embodiment, the doctor gap may be easily readjusted upon exchanging the developing unit so that the capacity operating rate may be improved.

According to a preferred embodiment of the present invention, the magnetic part and the nonmagnetic part are configured to be attached and detached from each other.

In one aspect of the present embodiment, the magnetic part may be easily detached from the nonmagnetic part upon exchanging the developing unit so that carrier particles of the developer may be prevented from adhering to the developer transporting amount controlling member and the doctor gap may be easily adjusted.

According to another preferred embodiment of the present invention, the developing unit is configured to rotate at a peripheral speed of at least 1.0 m/s.

In one aspect of the present embodiment, high image quality printing may be maintained for a long period of time even when high speed printing is performed, and the capacity operating rate may be improved.

According to another preferred embodiment of the present invention, the recording unit is disposed opposite a second magnetic pole of the magnetic poles of the developing unit;

the developing unit includes an internal portion inside which the magnetic poles are arranged, and a sleeve roller surface; and a maximum magnetic flux density in the normal direction of the second magnetic pole at the sleeve roller surface is at least 0.08 T.

In one aspect of the present embodiment, a desirable amount of developer may be arranged to pass through the doctor gap so that accurate image formation may be performed.

According to another preferred embodiment of the present invention, the developer includes a toner and a carrier, and the carrier has a volume average particle diameter of at least 65 μm.

In one aspect of the present embodiment, a desirable amount of developer may be arranged to pass through the doctor gap so that accurate image formation may be performed.

According to anther embodiment of the present invention, an imaging apparatus is provided that includes:

a developing apparatus including a developer transporting unit, a developing unit, and a developer transporting amount controlling member that includes a magnetic part and a nonmagnetic part, which nonmagnetic part is harder than the magnetic part and is fixed in position such that a portion of the nonmagnetic part is disposed closest to the developing unit;

a photoconductor drum including a surface that sustains an electrostatic image and attracts a developer that is transported by the developing apparatus;

a charger that charges the photoconductor drum;

an exposure device that exposes light on the charged photoconductor drum;

a transfer device that transfers a toner image developed from the electrostatic image onto a recording medium;

a cleaning unit that removes toner from the photoconductor drum after the toner image is transferred; and a fixing device that fixes the toner image transferred onto the recording medium.

In one aspect of the present embodiment, high image quality printing may be maintained for a long period of time even in an apparatus that is adapted to perform high speed printing. In another aspect of the present embodiment, the doctor gap may be easily readjusted upon exchanging the developing unit so that the capacity operating rate may be improved.

According to another embodiment of the present invention, a method is provided for exchanging a developing unit in a developing apparatus that includes a recording unit having a surface that sustains an electrostatic latent image and attracts a developer, a developer transporting unit that transports the developer, the developing unit including a magnetic pole that is configured to guide the developer to the recording unit, which recording unit, developer transporting unit, and developing unit have rotational center axes that are parallel to each other, and a developer transporting amount controlling member that is disposed opposite the magnetic pole of the developing unit and includes a magnetic part and a nonmagnetic part, wherein the developer is transported to the developing unit by the developer transporting unit and is used to develop a toner image from the electrostatic latent image on the recording unit, the method comprising the steps of:

detaching the magnetic part from the nonmagnetic part;

installing the developing unit in the developing apparatus;

adjusting a gap between the nonmagnetic part and the developing unit; and attaching the magnetic part to the nonmagnetic part after adjusting the gap.

In one aspect of the present embodiment, high image quality printing may be maintained for a long period of time even in an apparatus that is adapted to perform high speed printing. In another aspect of the present embodiment, the doctor gap may be easily readjusted upon exchanging the developing unit so that the capacity operating rate may be improved.

DESCRIPTION OF THE PREFERRED EMBODIMENTS

In the following, preferred embodiments of the present invention are described with reference to the accompanying drawings.

First, a configuration of a doctor blade as a developer transporting amount controlling member according to an embodiment of the present invention is described.

Figure 1:
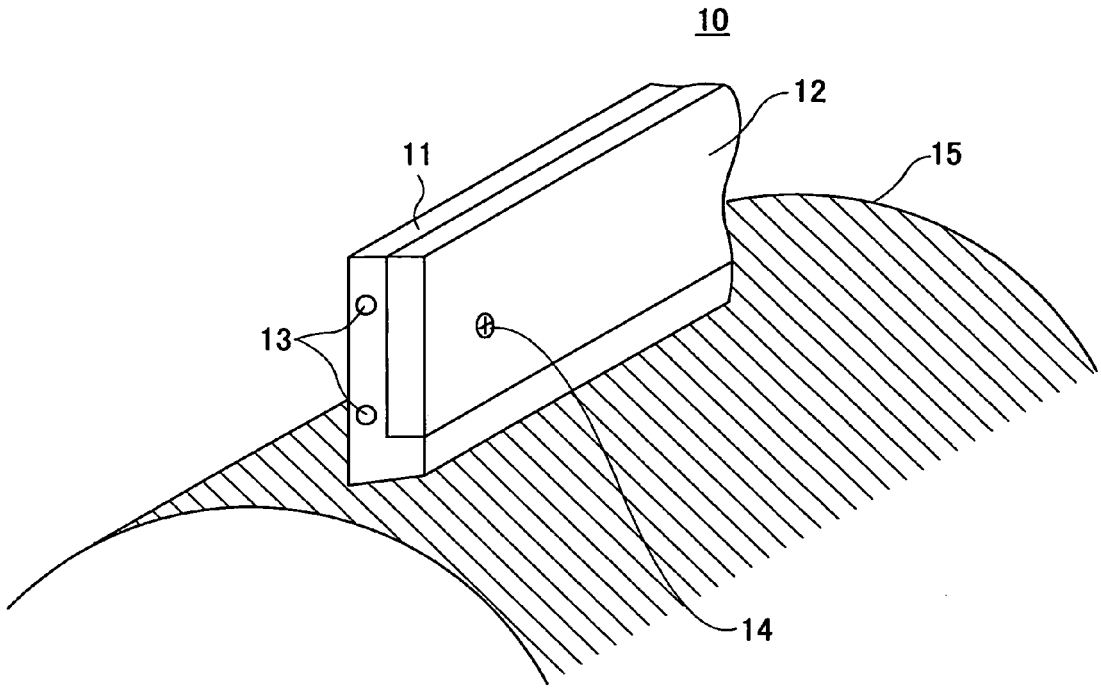
FIG. 1 is a diagram showing an exemplary configuration of a doctor blade according to an embodiment of the present invention.

FIG. 1 is a diagram showing an exemplary configuration of a doctor blade according to an embodiment of the present invention. The illustrated doctor blade 10 includes a nonmagnetic part 11 and a magnetic part 12. In the present embodiment the material of the portion of the doctor blade 10 that comes into frictional contact with the developer is arranged to have lower magnetic permeability and greater hardness compared to the magnetic part 12. Specifically, in a case where the magnetic part 12 is arranged to come into direct contact with the magnetic brush, the magnetic part 12 may be vulnerable to wear, and therefore, a material that is harder than the magnetic part 12 is used at the portion coming into frictional contact with the magnetic brush.

In the present embodiment, the nonmagnetic part 11 is fixed to a developing apparatus (not shown) by a fixing member such as a screw 13. The magnetic part 12 is detachably fixed to the nonmagnetic part 11 by a fixing member such as a screw 14. The doctor blade 10 is fixed to a position opposite a developing roller 15 (developing unit) such that the nonmagnetic part 11 may be closest to the position of a magnetic pole of the developing roller 15. It is noted that the fixing members 13 and 14 are not limited to screws. For example, hooks or other types of engaging members may be used to latch or bind the nonmagnetic part 11 and the magnetic part 12. In another example, concavo-convex structures may be used to engage the nonmagnetic part 11 and the magnetic part 12.

It is noted that the magnetic part 12 is preferably made of a material that has a maximum magnetic permeability of at least 3000 such as soft magnetic iron, a silicon steel plate, a Permalloy, or magnetic stainless steel. In this way adequate magnetic bead chain formation at the developer transporting amount controlling portion may be ensured, and a relatively wide doctor gap (i.e., space between the nonmagnetic part 11 and the developing roller 15) may be secured. It is noted that when the maximum magnetic permeability of the material used for the magnetic part 12 is less than 3000, the doctor blade 10 may not have properties much different from a doctor blade that is entirely made up of a nonmagnetic material.

The nonmagnetic part 11 is preferably made of a material that has a maximum magnetic permeability of no more than 100 and is arranged to be harder than the magnetic part 12. For example, SUS 303 with a Vickers hardness value (HV) of approximately 200 or SUS 304 that may be hardened to approximately HV 400 (in which case its magnetic permeability may be approximately 30) may be used as the material of the nonmagnetic part 11. In a preferred embodiment, the material of the nonmagnetic part 11 preferably has a hardness HV within a range of 200-600, and a magnetic permeability of less than or equal to 50.

Figure 2A:
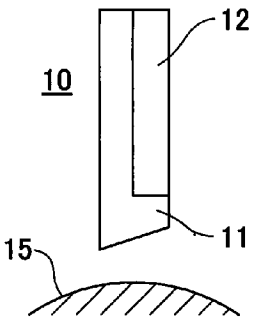
FIGS. 2A-2F are diagrams showing exemplary attachment configurations of a nonmagnetic part and a magnetic part of a doctor blade.

It is noted that the attachment configuration of the nonmagnetic part 11 and the magnetic part 12 of the doctor blade 10 is not limited to the illustrated example of FIG. 1. In FIGS. 2A-2F, a variety of possible attachment configurations of the nonmagnetic part 11 and the magnetic part 12 are shown. FIG. 2A shows the attachment configuration employed in the example of FIG. 1. FIGS. 2B-2F show other exemplary configurations of the doctor blade 10 having a detachable magnetic part 12 attached to a fixed nonmagnetic part 11.

Figure 2B:
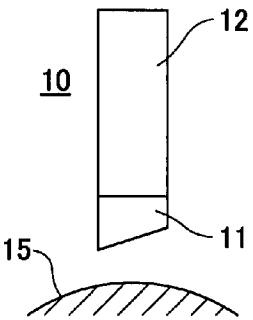
Figure 2C:
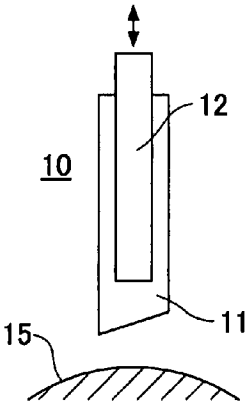
Figure 2D:
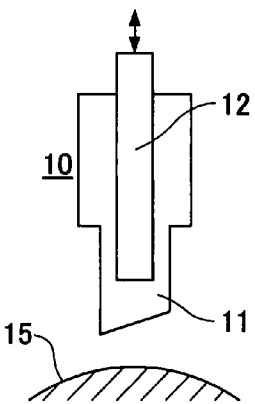

Specifically, as is shown in FIG. 2B, the nonmagnetic part 11 may be disposed on the face opposing the sleeve roller 15B. Also, as is shown in FIGS. 2C and 2D, the doctor blade 10 may have an interleaved structure in which the nonmagnetic part 11 is arranged on both sides of the magnetic part 12.

Figure 2E:
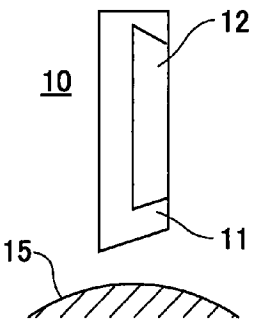
Figure 2F:
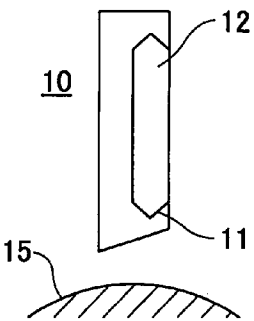

Also, as is shown in FIGS. 2E and 2F, the nonmagnetic part 11 may have a concave portion arranged into a rectangular shape, a tapered shape, or a jagged shape, for example, on one side, and the magnetic part 12 may be slid into such a concave portion to detachably engage the nonmagnetic part 11.

By using a magnetic material for the doctor blade 10 and arranging a hard material at the portion coming into frictional contact with the developer, the doctor blade 10 may be prevented from wearing out in a short period of time even when it is used in a high speed imaging apparatus where the peripheral speed of the developing roller 15 is greater than or equal to 1.0 m/s, for example. In turn, inconveniences created by wear of the doctor blade 10 such as an increase in the developer transporting amount resulting from enlargement of the doctor gap or the partial widening of the doctor gap may be prevented, for example.

It is noted that in a high speed apparatus, even when measures are taken to reduce wear of the doctor blade 10 as is described above, the doctor blade 10 as well as the surface of the sleeve roller arranged on the periphery of the developing roller 15 that come into frictional contact with the developer upon controlling the developer transporting amount may wear out over time. Therefore, the developing roller 15 may have to be exchanged and the doctor gap may have to be readjusted.

In the present embodiment, by arranging the nonmagnetic part 11 and the magnetic part 12 to be detachable, the doctor gap may be adjusted while the magnetic part 12 is detached from the nonmagnetic part 11. Specifically, the gap between the nonmagnetic part 11 and the surface of the sleeve roller arranged on the periphery of the developing roller 15 may be measured and adjusted while the magnetic part 12 is detached so that carrier particles may be prevented from adhering to the doctor blade 10 while the doctor gap is being adjusted to thereby facilitate the gap adjustment operations.

In the following, a developing apparatus according to an embodiment of the present invention that includes the doctor blade as is described above, and an imaging apparatus according to an embodiment of the present invention that employs such a developing apparatus are described.

<Imaging Apparatus>

Figure 3:
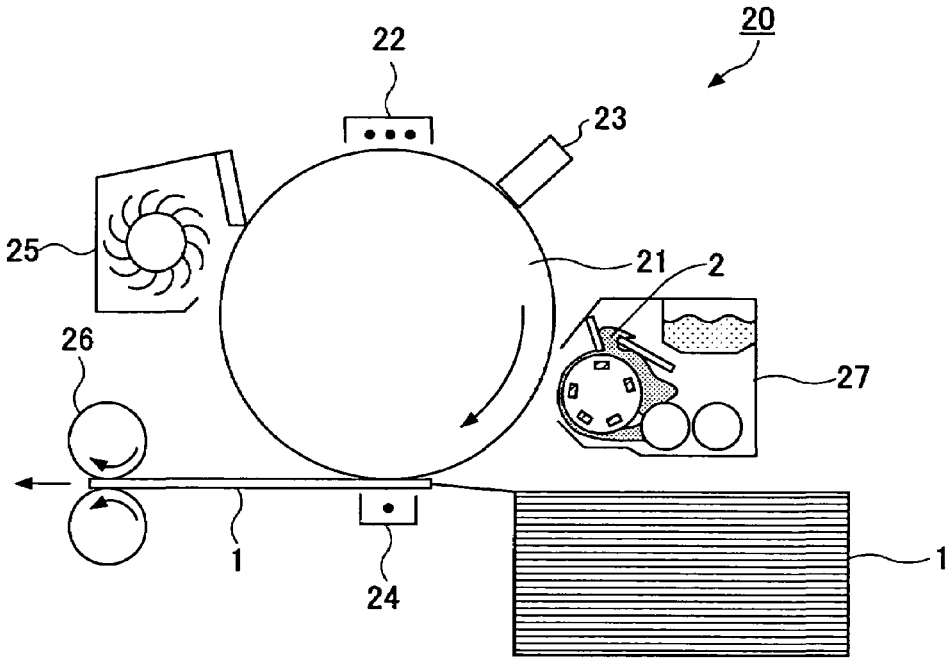
FIG. 3 is a diagram showing an exemplary configuration of an electrostatic recording apparatus according to an embodiment of the present invention.

FIG. 3 is a diagram showing an exemplary configuration of an electrostatic recording apparatus as an imaging apparatus according to an embodiment of the present invention. The illustrated electrostatic recording apparatus 20 includes a photoconductor drum 21, a charger 22, an exposure device 23,.a transfer device 24, a cleaner 25, a fixing device 26, and a developing apparatus 27.

The photoconductor drum 21 forms an electrostatic latent image on its surface for forming a desired image. It is noted that the photoconductor drum 21 corresponds to a recording unit. The charger 22 applies an electrical charge to the photoconductor drum 21. The exposure device 23 exposes light on the charged photoconductor drum 21.

The transfer device 24 transfers a toner image developed from the electrostatic latent image on a recording medium 1 such as paper. The cleaner 25 removes toner remaining on the photoconductor drum after the toner image is transferred. The fixing device 26 fixes the toner image transferred onto the recording medium 1 from the photoconductor drum 21. The developing apparatus 27 forms a toner image on the photoconductor drum 21 using a developer 2 to develop the latent image into a visible image (toner image).

In the following, image formation performed in the electrostatic recording apparatus 20 of FIG. 3 is described. To form an image in the electrostatic recording apparatus 20, the photoconductor drum 21 is rotated at a peripheral speed of at least 800 mm/s (referred to as "processing speed" hereinafter) in the clockwise direction in FIG. 3, and the surface of the photoconductor drum 21 is evenly charged to −600 V by the charger 22.

Then, light is exposed on the photoconductor drum 21 by a light source such as an LED (not shown) of the exposure device 23 so that a latent image with a background portion of −600 V and an image portion of −50 V may be formed. When the latent image reaches a position opposite the developing apparatus 27 by the rotation of the photoconductor drum 21, the developing apparatus 27 applies the developer 2 on a predetermined developer applying region of the photoconductor drum 21 so that the toner of the developer 2 adheres to the image portion, namely, the portion of the photoconductor drum that is exposed by the exposure device 23. In this way, a toner image may be formed on the photoconductor drum 21.

Then, when the toner image formed on the photoconductor drum 21 reaches a position opposite the transfer device 24 by the rotation of the photoconductor drum 21, the recording medium 1 such as paper stacked at an appropriate position is inserted between the transfer device 24 and the photoconductor drum 21, and the toner image is transferred to the recording medium 1 by the transfer device 24. Then, the toner image transferred to the recording medium is fixed by the fixing device 26.

Also, it is noted that toner remaining on the photoconductor drum 21 after the toner image is transferred to the recording medium 1 is removed by the cleaner 25 and discarded thereafter.

<Developing Apparatus>

Figure 4:
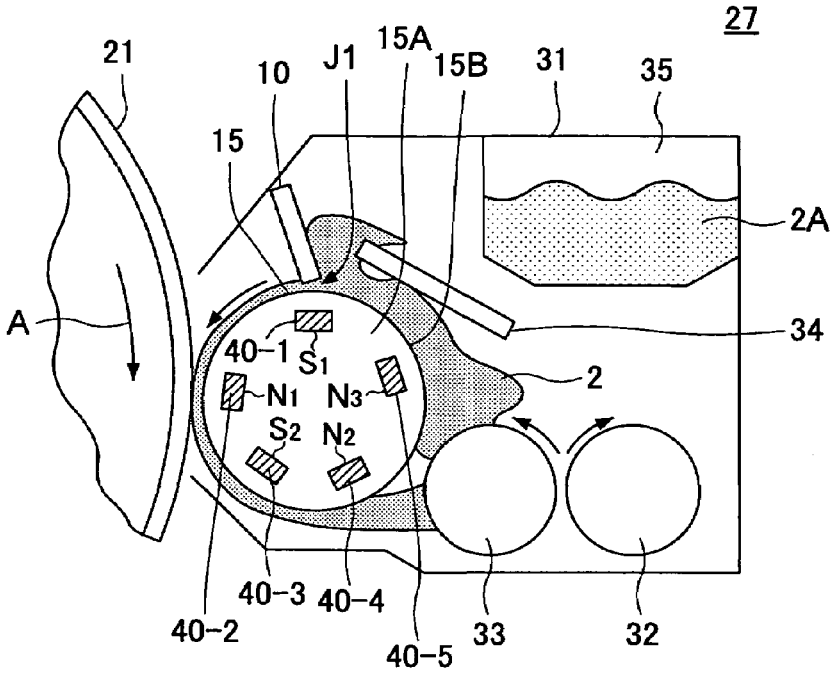
FIG. 4 is a diagram showing an exemplary configuration of a developing apparatus according to an embodiment of the present invention.

FIG. 4 is a diagram showing an exemplary configuration of the developing apparatus 27. In the illustrated example of FIG. 4, the developing apparatus 27 includes a developer accommodating container 31, a first transporting member 32, a second transporting member 33, a developing roller 15, a doctor blade 10, a guide plate 34, and a toner supply unit 35. The first transporting member 32, the second transporting member 33, and the developing roller 15 are interconnected to and driven by a drive mechanism such as a motor (not shown) via a drive communicating mechanism including a gearwheel (not shown), for example. It is noted that the first transporting member 32 and the second transporting member 33 may comporise to a developer transporting unit.

As is shown in FIG. 4, the developer accommodating container 31 accommodates the developer 2, which is primarily made up of nonmagnetic toner particles and magnetic carrier particles.

A carrier particle is made up of a magnetic carrier core that is evenly coated by insulating resin. The insulating resin coating the surface of the carrier core is arranged to have desirable frictional charge characteristics with respect to the toner. The toner is included in the developer 2 at a weight ratio of 3-10%. In a preferred embodiment, the average carrier particle diameter is less than or equal to 65 μm, and the saturation magnetization of the carrier is no more than 50 emu/g. In this way, an appropriate amount of toner may be controlled to pass through the doctor gap so that an accurate image formation may be performed.

It is noted that the volume average particle diameter of the carrier may be measured using a commercially available particle size distribution analyzer that employs a laser diffraction/dispersion method such as the Microtrack (by Nikkiso Co., Ltd.) or the HELOS & RODOS (by Sympatec GmbH).

Also, it is noted that saturation magnetization refers to the magnetization at a saturation point where magnetization change no longer occurs even when the magnetic field is increased. For example, the saturation magnetization of the carrier may be measured by a commercially available analyzer such as a vibrating sample magnetometer, or the BH Analyzer (by Iwatsu Electric Co., Ltd.).

The carrier core material may be made of a magnetite, a Mn—Mg ferrite, or a Cu—Zn ferrite, for example. When the carrier is put under stress for a long period of time within the developing apparatus 27, the toner may stick to the surface of the carrier, or the insulating resin may be exfoliated so that the frictional charge characteristics of the carrier surface with respect to the toner may change. In such a case, the charge of the developer 2 cannot be maintained at a fixed level so that image quality degradation may occur.

When the processing speed of the electrostatic recording apparatus 20 exceeds 800 mm/s, the rotating members of the developing roller 15, the first transporting member 32, and the second transporting member 33 within the developing apparatus 27 are rotated at high speed so that stress applied to the developer 2 accommodated within the developing apparatus 27 may be increased. As a result, the insulating resin covering the surface of the carrier core may exfoliate from the carrier core surface to cause degradation of the developer.

As is described above, the toner is included in the developer 2 at a weight ratio of 3-10%, and when the developer 2 is used by the developing apparatus 27 during image formation operations (printing operations) of the electrostatic recording apparatus 1, only the toner within the developer 2 is consumed. Accordingly, the weight ratio of the toner within the developer 2 in the developing apparatus 27 decreases.

In view of such circumstances, the toner supply unit 35 is configured to supply toner 2A to the developing apparatus 27. Specifically, the supplied toner 2A is transported by the first transporting member 32 and the second transporting member 33 to be mixed with the developer 2 that is already accommodated inside the developing apparatus 27.

The first transporting member 32 and the second transporting member 33 are arranged into substantially cylindrical shapes, and the rotational center axes of the first and second transporting members 32 and 33 are orthogonal to the sectional plane illustrated in FIG. 4 and parallel to the rotational center axis of the photoconductor drum 21. Also, the first transporting member 32 and the second transporting member 33 are arranged to face each other at close range within the developer accommodating container 31 and are positioned parallel to each other on a substantially horizontal virtual plane. The guide plate 34 is used for guiding the developer 2 toward the doctor gap.

As is shown in FIG. 4, the toner supply unit 35 is positioned right above the first transporting member 32. The toner supply unit 35 is configured to supply the toner 2A to the developer accommodating container 31.

The developing roller 15 is arranged at the side of the second transporting member 33 opposite the side at which the first transporting member 33 is disposed (i.e., left side of the second transporting member 33 in FIG. 4). The developing roller 15 has a substantially cylindrical shape and is made up of a cylinder portion 15A and a sleeve roller 15B that is arranged around the periphery of the cylinder portion 15A and is capable of rotating with respect to the rotational center axis of the cylinder portion 15A. The developing roller 15 faces the photoconductor drum 21 on one side, and faces the second transporting member 33 on the other side. The rotational center axis of the developing roller 15 is arranged to be parallel to the rotational center axes of the photoconductor drum 21 and the second transporting member 33. The developing roller 15 is configured to supply the developer 2 that is transported by the second transporting member 33 to the photoconductor drum 21.

Also, it is noted that the five permanent magnets 40-1 through 40-5 with magnetic poles $S_1$, $N_1$, $S_2$, $N_2$, and $N_3$, respectively, are arranged at predetermined intervals along the inner perimeter of the developing roller 15 close to the surface of the developing roller 15. The permanent magnets 40-1 through 40-5 attract the developer 2 toward the surface of the sleeve roller 15B of the developing roller 15 so that the developer 2 may be transported.

The permanent magnets 40-1 through 40-5 with the magnetic poles $S_1$, $N_1$, $S_2$, $N_2$, and $N_3$, respectively, are arranged in this order along the downstream rotating direction of the sleeve roller 15B (counterclockwise direction in FIG. 4).

It is noted that the magnetic pole N, arranged opposite the photoconductor drum 21 may have a maximum magnetic flux density of 0.1 T at the surface of the sleeve roller 15B. The other magnetic poles may have a magnetic field of approximately 0.04-0.08 T, for example. Also, it is noted that in a case where a carrier with a small particle size is used, the amount of carrier that adheres to the photoconductor drum 21 may increase upon developing an image, and thereby, the magnetic field of the magnetic pole opposing the photoconductor drum 21 is preferably at least 0.1 T.

The developing roller 15 is configured to rotate in the counterclockwise direction in FIG. 4 to carry the developer 2 transported from the second transporting member 33 onto the photoconductor drum 21.

The doctor blade 10 is disposed further upstream in the rotating direction of the sleeve roller 15B from the position at which the photoconductor drum 21 and the developing roller 15 face each other. The doctor blade 10 is arranged so that the nonmagnetic part 11 faces the sleeve roller 15B of the developing roller 15. The nonmagnetic part 11 is fixed to the developer accommodating container 31 of the developing apparatus 27. The developer 2 is arranged to pass through the doctor gap corresponding to the minimum distance between the sleeve roller 15B and the doctor blade 10 in order to be a predetermined amount upon being conveyed to the photoconductor drum 21 by the sleeve roller 15B. In the present embodiment, the doctor gap is 0.8 mm; however, the dimension of the doctor gap is not limited to such a value.

As is shown in FIG. 4, the magnetic pole $S_1$ corresponding to a transporting magnetic pole is arranged inside the developing roller 15 at a position facing the doctor blade 10. At the position of the doctor gap, namely, the developer amount controlling position, the doctor blade 10 having the magnetic part 12 is arranged to face the magnetic pole $S_1$. In this way, the magnetic line normal components are directed toward the magnetic part 12 from the surface of the developing roller 15. Accordingly, the developer 2 is aligned in the direction of this magnetic line of force to form a chain. When the aligned developer chain passes through the doctor gap by the rotation of the sleeve roller 15B, the developer chain is cut by the doctor blade 10 so that the amount of the developer 2 being transported to the photoconductor 21 may be controlled. By including the magnetic part 12 in the doctor blade 10, the amount of the developer 2 passing through the doctor blade 10 may be reduced compared to a case where a nonmagnetic doctor blade is used.

In other words, to control the amount of the developer 2 being transported by the developing roller 15 to a predetermined amount, the doctor gap may be wider in the case where the doctor blade 10 including the magnetic part 12 is used and a transporting magnetic pole is arranged within the developing roller 15 opposite the doctor blade 10 as in the present embodiment. Accordingly, variations in the developer transporting amount due to variations in the doctor gap caused by deviations in the processing accuracy and assembly accuracy of device components may be reduced. Also, the developer transporting amount may be controlled by a wider doctor gap so that the developer is not excessively compressed upon being controlled to be a predetermined amount. In this way, stress applied to the developer 2 may be reduced.

It is noted that the surface of the sleeve roller 15B of the developing roller 15 may be processed through metal blasting to have a surface roughness Rz of approximately 30-90 μm. Oftentimes, the surface roughness of the sleeve roller 15B in a high speed imaging apparatus is arranged to be greater than that in an imaging apparatus operating at a lower speed in order to prevent the developer 2 from slipping across the sleeve roller 15B surface upon being transported. In such a high speed imaging apparatus, since the developer 2 is transported at high speed, the doctor blade 10 that comes into frictional contact with the developer 2 upon controlling the developer transporting amount may susceptible to wear. Accordingly, in the present embodiment, a hard material is used at the portion of the doctor blade 10 that comes into frictional contact with the developer 2 so that the doctor blade 10 may be prevented from wearing out in a short period of time.

Also, in a case where the sleeve roller 15B is worn out and the developing roller 15 has to be exchanged, the magnetic part 12 of the doctor blade 10 may be easily detached in the present embodiment so that carrier particles adhered to the doctor blade 10 may be easily removed when readjustment of the doctor gap has to be performed after exchanging the developing roller 15 and the gap adjustment operations may be facilitated.

It is noted that the surface roughness Rz as is described above represents a ten-points average roughness based on the JIS B0601' 94 standard. Specifically, the surface roughness Rz represents the sum of the average peak height of the five highest peaks of the roughness curve and the average depth of the five deepest valleys of the roughness curve. The surface roughness Rz may be measured by a surface roughness analyzer such as Surfcom (by Tokyo Seimitsu Co., Ltd.) or Talysurf (by Taylor Hobson Ltd.).

In the case of forming an image, the toner 2A of the developer 2 is stirred by the first transporting member 32 and the second transporting member 33 to come into frictional contact with the carrier of the developer 2 and be charged to a predetermined charge value within a range of −10 μC/g through −30 μC/g. The developer 2 charged at the predetermined charge value is guided toward the developing roller 15 to be attracted to the surface of the sleeve roller by the magnetic pole $N_3$. Then, the developer 2 on the sleeve roller 15B surface is transported by the rotation of the sleeve roller 15B to reach the position of the magnetic pole $S_1$ opposite the doctor blade 10. The sleeve roller 15B rotates in a direction (counterclockwise direction in FIG. 4) relative to the rotating direction A of the photoconductor drum 21 as is indicated by arrow A in FIG. 4 (clockwise direction in FIG. 4), and the peripheral speed of the sleeve roller 15B is 1.1-2.0 times the peripheral speed of the photoconductor drum 21.

The amount of the developer 2 is controlled to a predetermined transporting amount by the doctor blade 10 at a transporting amount controlling position J1 shown in FIG. 4 after which the developer 2 is guided to a developing portion. At the developing portion of the developing roller 15, magnetic bead chain (magnetic brush) formation of the developer 2 is induced by the magnetic pole $N_1$ so that the developer 2 comes into frictional contact with the surface of the photoconductor drum 21 as the developing roller 15 rotates in the counterclockwise direction in FIG. 4 relative to the moving direction of the surface of the photoconductor drum 21, which rotates in the clockwise direction in FIG. 4.

Then, a developing bias is applied to the developing roller 15 so that the toner included in the developer 2 on the developing roller 15 may be transferred to a latent image formed on the photoconductor drum 21 to create a visible toner image. Then, the developer 2 moving past the developing portion is removed from the developing roller 15 by the repelling magnetic field between the magnetic poles $N_2$ and $N_3$ that have the same polarity so that the developer 2 may be conveyed to the second transporting member 33 and circulated within the developing apparatus 27. The visible toner image created on the photoconductor drum 21 is transferred to a recording medium 1 such as paper by the transfer device 24 shown in FIG. 3, and the image transferred on the recording image 1 is fixed by the fixing device 26.

It is noted that the charge of the toner may be measured using a suction Faraday cage apparatus such as Model 210 HS-2A (by Trek Inc.). Specifically, the toner may be extracted through a mesh filter with a pore size of 26 μm (500 mesh filter) from a sample of the developer 2 amounting to approximately 200 mg that is obtained from the developing device, and the toner charge-to-mass ratio (Q/M) may be calculated using a stabilized value of the measured toner charge, for example.

As can be appreciated from the above descriptions, by employing the electrostatic recording apparatus 27 and the developing apparatus 20 according to embodiments of the present invention, the transporting amount of the developer 2 may be controlled to a small amount without having to severely reduce the dimension of the doctor gap even in an apparatus that is adapted for high speed printing. In this way, high image quality printing may be stably performed. Also, since measures are implemented against wear of the portion of the doctor blade 10 coming into contact with the developer 2, apparatus performance may be maintained for a relatively long period of time. Accordingly, a developer transporting amount controlling member, a developing apparatus, and an imaging apparatus with an improved capacity operating rate may be provided.

<Developing Roller Exchange Method>

In the following, a method for exchanging the developing roller 15 including the doctor blade 10 according to an embodiment of the present invention is described with reference to FIGS. 5, 6A and 6B.

Figure 5:
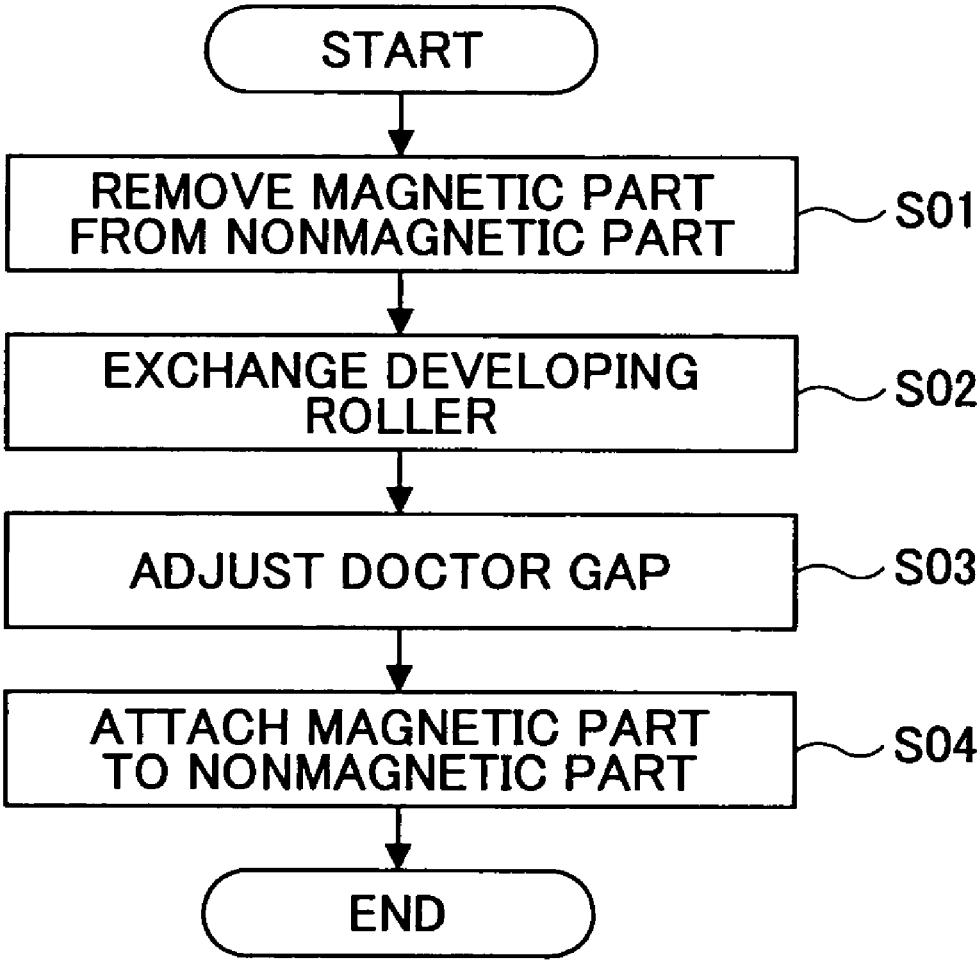
FIG. 5 is a flowchart illustrating an exemplary method for exchanging a developing roller according to an embodiment of the present invention.

FIG. 5 is a flowchart showing exemplary steps for exchanging the developing roller 15. FIGS. 6A and 6B are diagrams illustrating exemplary cases of detaching the magnetic part 12 upon exchanging the developing roller 15.

Figure 6B:
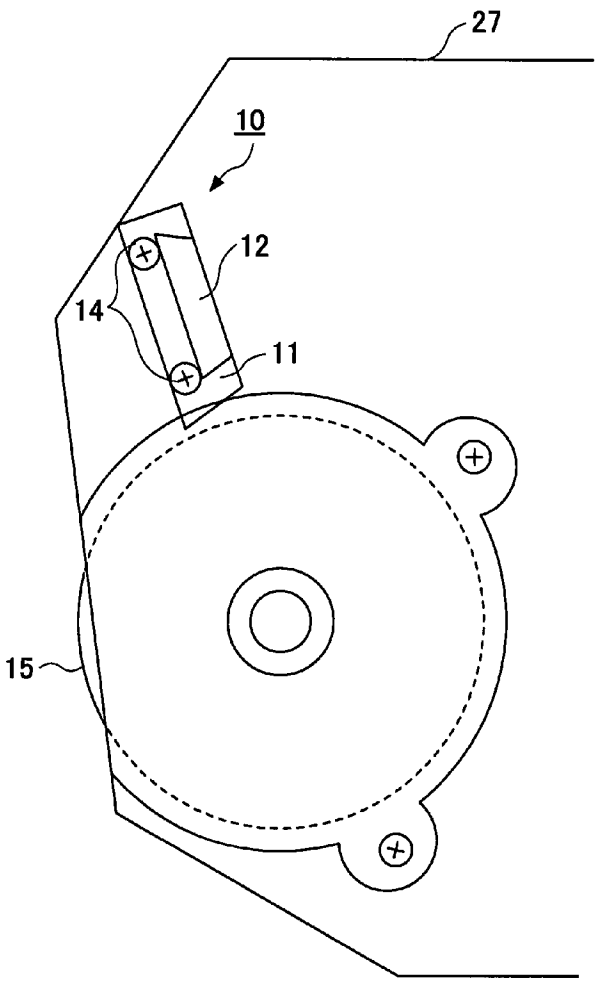
FIGS. 6A and 6B are diagrams illustrating exemplary cases of detaching a magnetic part from a nonmagnetic part upon exchanging the developing roller.
Figure 6A:
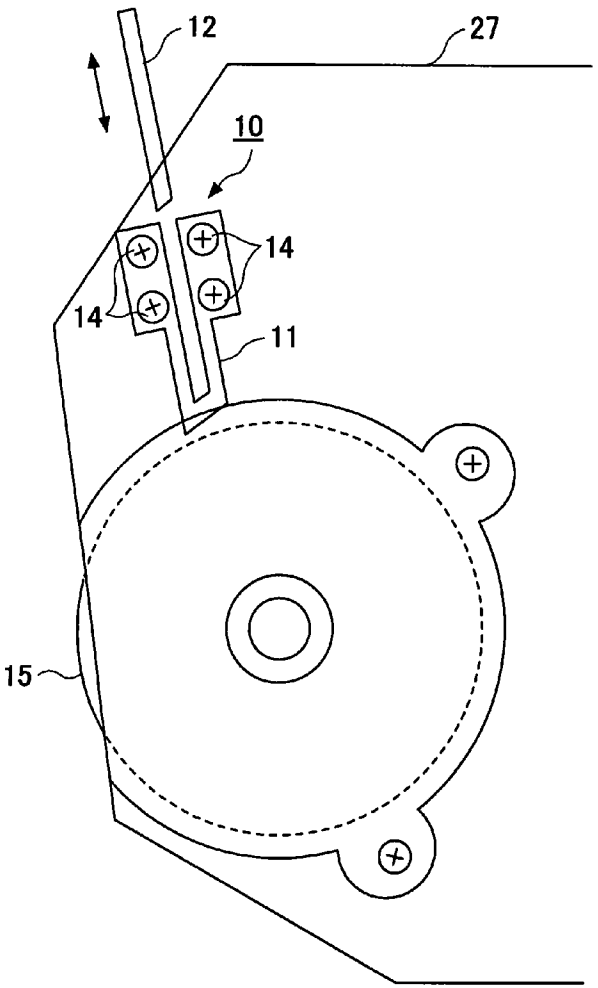

It is noted that in the examples illustrated in FIGS. 6A and 6B, the doctor blade 10 has the configurations shown in FIGS. 2D and 2E, respectively. Also, in the examples illustrated in FIGS. 6A and 6B, the nonmagnetic part 11 is fixed to the developing apparatus 27 by fixing members 14 such as screws.

The method of exchanging the developing roller 15 of the developing apparatus 27 according to the illustrated embodiment of FIG. 5 involves detaching the magnetic part 12 from the nonmagnetic part 11 (S01), replacing the used developing roller 15 with a new developing roller 15 (S02), adjusting the doctor gap (S03), and reattaching the magnetic part 12 to the nonmagnetic part 11 (S04).

According to one example, in the step of exchanging the developing roller 15, if the developing roller 15 is held in place by a bushing that is pivotally supported at one end, the bushing may be released so that the developing roller 15 may be removed from the opening to be replaced by a new developing roller 15. After the new developing roller is installed, the bushing may be fixed back in place, and the gap between the nonmagnetic part 11 and the developing roller 15 may be adjusted. Then, the magnetic part 12 may be reattached to the nonmagnetic part 11.

In the case where the doctor blade 10 has the configuration as is shown in FIG. 6A, the doctor blade 10 may be moved to an appropriate position so that a concave portion arranged at the nonmagnetic part 11 may be oriented in the direction indicated by the arrow shown in FIG. 6A, and the magnetic part 12 may be detached from the nonmagnetic part 11 along this direction to thereby prevent the developer 2 from being attracted to the magnetic part 12.

In the case where the doctor blade 10 has the configuration as is shown in FIG. 6B, the contacting interface between the magnetic part 12 and the nonmagnetic part 11 is arranged into a tapered shape so that the magnetic part 12 may be fixed to the nonmagnetic part 11 without using a fixing member such as a screw. In FIG. 6B, the magnetic part 12 may be slid along the forward direction or backward direction with respect to FIG. 6B to detach the magnetic part 12 from the nonmagnetic part 11.

According to the above-described examples, the magnetic part 12 may be easily detached from the nonmagnetic part 11 upon exchanging the developing roller 15 and adjusting the doctor gap. Also, carrier particles may be prevented from adhering to the doctor blade 10 so that the doctor gap may be easily adjusted.

As can be appreciated from the above descriptions, according to an aspect of the present invention, high image quality printing that is free of printing density degradation or carrier jumping may be maintained for a long period of time even in an apparatus adapted to perform high speed printing, and the doctor gap may be easily readjusted upon exchanging the developing roller so that the capacity operating rate may be improved.

It is noted that the developer transporting amount controlling member, the developing apparatus, the imaging apparatus, and the developing unit exchange method according to embodiments of the present invention are not limited to the examples described above. For example, although the photoconductor drum is used as an image holding unit (recording unit) in the above illustrated embodiment, a photoconductor belt that moves around a predetermined orbit may be used as an alternative. Also, the developing apparatus is not limited to the configuration described above, and for example, two or more developing rollers may be included in the developing apparatus.

Also, it is noted that the developer transporting amount controlling member, the developing apparatus, the imaging apparatus, and the developing unit exchange method according to embodiments of the present invention may be applied to an electrophotographic printer that performs high speed printing, an electrostatic recording apparatus such as a copier, and various other apparatuses that are configured to transport magnetic particles using magnetic force and control the height of magnetic bead chains formed by the magnetic force.

Although the present invention is shown and described with respect to certain preferred embodiments, it is obvious that equivalents and modifications may occur to others skilled in the art upon reading and understanding the specification. The present invention includes all such equivalents and modifications, and is limited only by the scope of the claims.

The present application is based on and claims the benefit of the earlier filing date of Japanese Patent Application No. 2006-042603 filed on Feb. 20, 2006, the entire contents of which are hereby incorporated by reference.

What is claimed is:

1. A developing apparatus comprising:

a recording unit having a surface that sustains an electrostatic latent image and attracts a developer;

a developer transporting unit that transports the developer;

a developing unit that includes a plurality of magnetic poles and is configured to guide the developer to the recording unit; and a developer transporting amount controlling member that is disposed opposite a first magnetic pole of the magnetic poles of the developing unit; wherein the recording unit, the developer transporting unit, and the developing unit have rotational center axes that are parallel to each other;

the developer is transported to the developing unit by the developer transporting unit and is used to develop the latent image formed on the surface of the recording unit into a visible image; and the developer transporting amount controlling member includes a magnetic part and a nonmagnetic part that is harder than the magnetic part, the nonmagnetic part being fixed in position such that a portion of the nonmagnetic part is disposed closest to the developing unit; and wherein the recording unit is disposed opposite a second magnetic pole of the magnetic poles of the developing unit, wherein the developing unit includes an internal portion inside which the magnetic poles are arranged, and a sleeve roller surface, and wherein a maximum magnetic flux density in the normal direction of the second magnetic pole at the sleeve roller surface is at least 0.08 T.

2. The developing apparatus as claimed in claim 1, wherein the magnetic part and the nonmagnetic part are configured to be attached and detached from each other.

3. The developing apparatus as claimed in claim 1, wherein the developing unit is configured to rotate at a peripheral speed of at least 1.0 m/s.

4. The developing apparatus as claimed in claim 1, wherein the developer includes a toner and a carrier; and the carrier has a volume average particle diameter of at least 65 μm.

5. The developing apparatus as claimed in claim 1, wherein a magnetic part of said developer transporting amount controlling member has a maximum magnetic permeability equal to or greater than 3000, and a non magnetic part of said developer transporting amount controlling member has a magnetic permeability equal to or smaller than 50.

6. An imaging apparatus comprising:

a developing apparatus including a developer transporting unit, a developing unit comprising a plurality of magnetic poles, and a developer transporting amount controlling member that is disposed opposite a first magnetic pole of the magnetic poles of the developing unit and that includes a magnetic part and a nonmagnetic part, which nonmagnetic part is harder than the magnetic part and is fixed in position such that a portion of the nonmagnetic part is disposed closest to the developing unit;

a photoconductor drum including a surface that sustains an electrostatic image and attracts a developer that is transported by the developing apparatus;

a charger that charges the photoconductor drum;

an exposure device that exposes light on the charged photoconductor drum;

a transfer device that transfers a toner image developed from the electrostatic image onto a recording medium;

a cleaning unit that removes toner from the photoconductor drum after the toner image is transferred; and a fixing device that fixes the toner image transferred onto the recording medium; and wherein a recording unit is disposed opposite a second magnetic pole of the magnetic poles of the developing unit, wherein the developing unit includes an internal portion inside which the magnetic poles are arranged, and a sleeve roller surface, and wherein a maximum magnetic flux density in the normal direction of the second magnetic pole at the sleeve roller surface is at least 0.08 T.

7. The developing apparatus as claimed in claim 6, wherein the magnetic part and the nonmagnetic part are configured to be attached and detached from each other.

8. The developing apparatus as claimed in claim 6, wherein the developing unit is configured to rotate at a peripheral speed of at least 1.0 m/s.

9. The developing apparatus as claimed in claim 6, wherein the developer includes a toner and a carrier; and the carrier has a volume average particle diameter of at least 65 μm.

10. The developing apparatus as claimed in claim 6, wherein a magnetic part of said developer transporting amount controlling member has a maximum magnetic permeability equal to or greater than 3000, and a nonmagnetic part of said developer transporting amount controlling member has a magnetic permeability equal to or smaller than 50.

11. A method for exchanging a developing unit in a developing apparatus that includes a recording unit having a surface that sustains an electrostatic latent image and attracts a developer, a developer transporting unit that transports the developer, the developing unit that includes a magnetic pole and is configured to guide the developer to the recording unit, which recording unit, developer transporting unit, and developing unit have rotational center axes that are parallel to each other, and a developer transporting amount controlling member that is disposed opposite the magnetic pole of the developing unit and includes a magnetic part and a nonmagnetic part, wherein the developer is transported to the developing unit by the developer transporting unit and is used to develop a toner image on the electrostatic latent image on the recording unit, the method comprising the steps of:

detaching the magnetic part from the nonmagnetic part;

installing the developing unit in the developing apparatus;

adjusting a gap between the nonmagnetic part and the developing unit; and attaching the magnetic part to the nonmagnetic part after adjusting the gap.

* * * * *